US008820411B2

(12) United States Patent
Churchill

(10) Patent No.: US 8,820,411 B2
(45) Date of Patent: Sep. 2, 2014

(54) DEEPWATER BLOW OUT THROTTLING APPARATUS AND METHOD

(75) Inventor: Frédérick Churchill, Montréal (CA)

(73) Assignee: Organoworld Inc., Montreal (Quebec) (CA)

( * ) Notice: Subject to any disclaimer, the term of this patent is extended or adjusted under 35 U.S.C. 154(b) by 394 days.

(21) Appl. No.: 13/156,662

(22) Filed: Jun. 9, 2011

(65) Prior Publication Data

US 2012/0312543 A1 Dec. 13, 2012

(51) Int. Cl.
*E21B 43/01* (2006.01)

(52) U.S. Cl.
CPC ..... *E21B 43/0122* (2013.01)
USPC ..... 166/363; 166/345; 166/97.1

(58) Field of Classification Search
CPC ..... E21B 43/0122
USPC ..... 166/363, 338, 344, 345, 351, 352, 364, 166/386, 85.4, 91.1, 97.1, 75.13; 137/315.02; 251/1.1–1.3; 405/224.2
See application file for complete search history.

(56) References Cited

U.S. PATENT DOCUMENTS 1,485,862 A * 3/1924 Lester ..... 166/97.1
2,897,895 A * 8/1959 Ortloff ..... 166/95.1
2,946,386 A * 7/1960 Jones ..... 166/75.13
4,323,118 A * 4/1982 Bergmann ..... 166/96.1
4,434,853 A * 3/1984 Bourgeois ..... 166/285
4,461,354 A * 7/1984 Buras et al. ..... 166/343
5,121,793 A * 6/1992 Busch et al. ..... 166/79.1
5,191,940 A * 3/1993 Alonso et al. ..... 169/69
7,546,880 B2 * 6/2009 Zhang et al. ..... 166/358
8,322,437 B2 * 12/2012 Brey ..... 166/363
8,434,557 B2 * 5/2013 Chaddick ..... 166/344
8,434,558 B2 * 5/2013 Swanson et al. ..... 166/368
2011/0274493 A1 * 11/2011 Cutts ..... 405/60
2011/0299930 A1 * 12/2011 Messina ..... 405/60
2012/0055573 A1 * 3/2012 Adams ..... 138/89
2012/0247784 A1 * 10/2012 Lacy ..... 166/363
2013/0020086 A1 * 1/2013 Anderson et al. ..... 166/339

OTHER PUBLICATIONS

"A Brief History of Offshore Oil Drilling," National Commission on the BP Deepwater Horizon Oil Spill and Offshore Drilling, Staff Working Paper No. 1, pp. 1-18.

* cited by examiner

*Primary Examiner* — Matthew Buck
(74) *Attorney, Agent, or Firm* — McDermott Will & Emery LLP

(57) ABSTRACT

A deepwater blow out throttling apparatus and method. The apparatus is sized to reach an equilibrium between the force of the oil flow against the equipment that constitute the apparatus during its assembly and the forces available from the ROV and the drill ship and connexion pipe to hold the pieces in position for assembly. This solution is applicable to all wells and requires sizing the diffusion transition spool and the throttling valves such that the forces of the flow of the free discharging oil can be overcome by the forces available from the ROV and drill ship. Downward loading from the drill ship during the throttling is applied as throttling generates forces and vibration that can exceed the physical strength of the riser piping and connections. Slow closing of the throttling device must be assured to avoid shocking (or water hammering) the oil well installation.

8 Claims, 6 Drawing Sheets

PRODUCTION SOLUTION

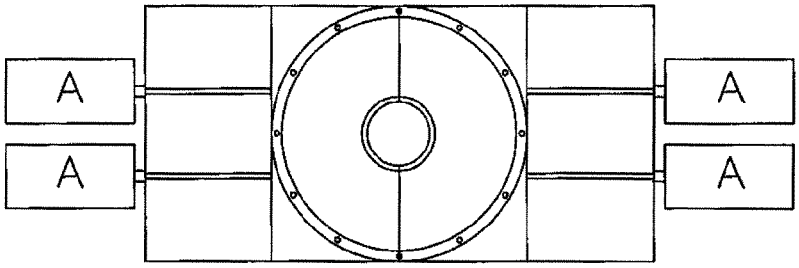
FIGURE 4b- CLOSED
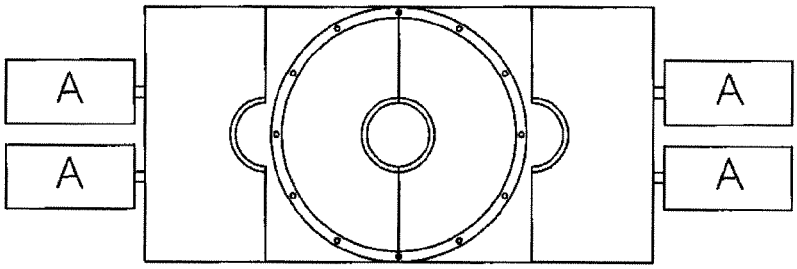
FIGURE 4a- OPEN
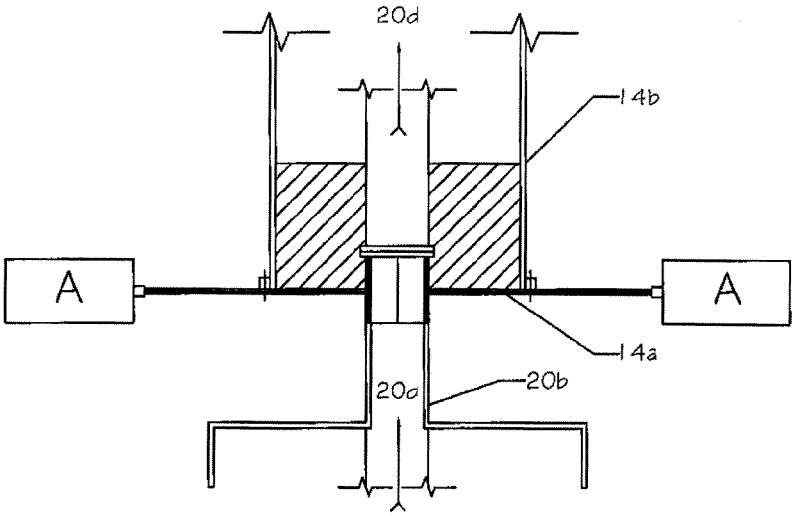
FIGURE 4- SECTION (CLOSED)

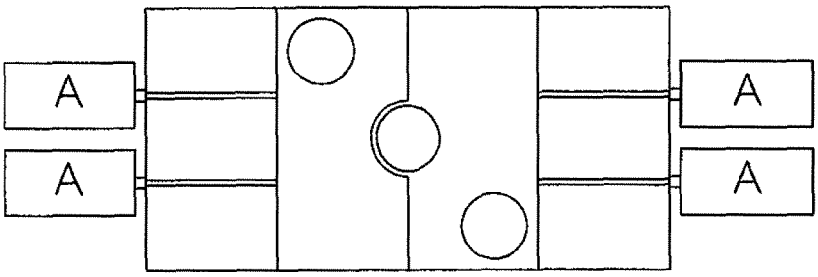
FIGURE 5b- CLOSED
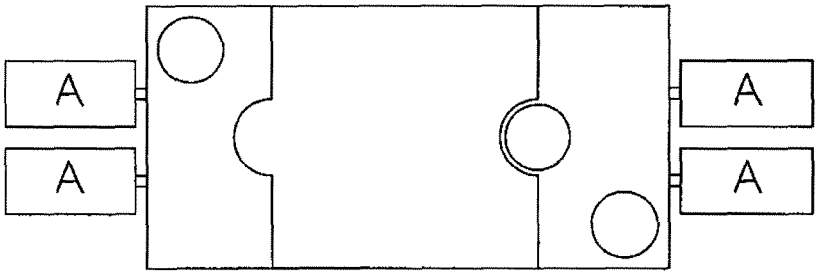
FIGURE 5a- OPEN
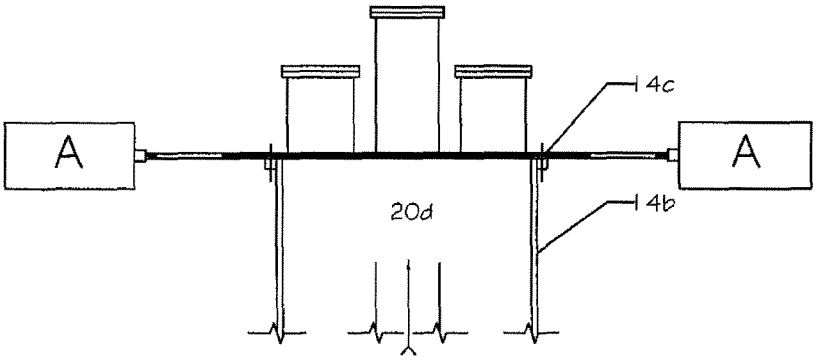
FIGURE 5- SECTION (CLOSED)

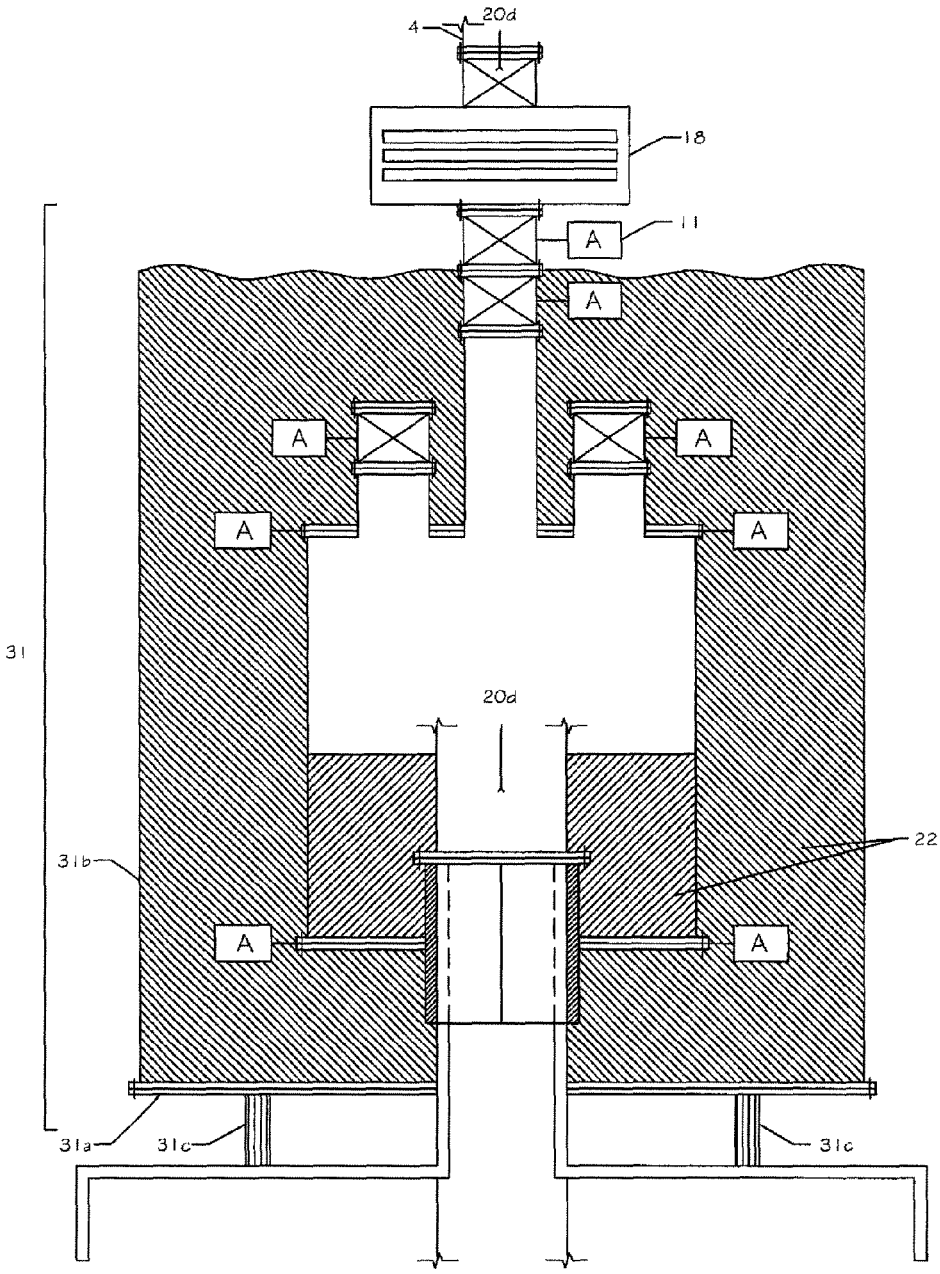
FIGURE 6-PRODUCTION SOLUTION

DEEPWATER BLOW OUT THROTTLING APPARATUS AND METHOD

FIELD OF THE INVENTION

The present invention generally relates to the technology and engineered-solution necessary to bring under control the blow out of a deepwater, high pressure oil well and more particularly to an apparatus that can be installed in sequential steps over the oil well riser using available equipment permitting the throttling back and establishing control of the oil flow with minimal stress on the piping and well head, as well as a method therefor.

BACKGROUND OF THE INVENTION

Oil exploration companies have begun to drill for oil in a mile or more of water in Canada, Australia, Norway, the United Kingdom, the USA and other countries. More drilling sites are located where the sea is very deep and because the distance to be drilled into the seabed is greater, the time required to perform the drilling is increasing. With increased drilling time at greater sea depths, the chances of a blow-out whereby the oil escapes from an undersea reservoir also increases.

An example of the trend would be the deepwater drilling being undertaken in the Gulf of Mexico. The company Chevron completed their Perdido Development in March of 2010 and is tethered in nearly 8,000 feet of water whereas, the infamous BP Macondo well that incurred a blow out, was tethered in 5,000 feet of water.

It is very difficult to deal with a blow out in very deep water because of the remoteness from the surface, the high hydraulic pressures in the oil reservoirs and the limited experience with these types of situations.

The major exposed elements of an undersea oil well include among others:

- A large diameter steel casing that is drilled or driven into place on the sea bed and solidly cemented to the floor of the ocean.
- The well-head is a large steel fitting that sits on the ocean floor and is attached to the steel casing.

Atop the well-head is a Blow Out Preventer (BOP) connected to the flanged discharge connection of the well-head. A BOP may contain several closing devices called 'rams' that serve different functions: for example cutting drill pipe or casing or sealing around drill pipe while leaving it intact. A BOP may also contain annular preventers that are hard rubber devices in the shape of a tire that is designed to expand and seal around drill pipe or else seal the well entirely if drill pipe is not present.

A production riser/pipe transfers the oil flow from the discharge flange of the BOP to a surface vessel. This top portion of the BOP stack is called the lower marine riser package (LMRP).

The first stage of defence against a blow out is proper drilling techniques and an accurate control of the mud density and close tracking of its return flow rate. The principal second stage of defence to prevent a blow out is the Blow Out Preventer or BOP. If there is a problem of a potential blow out at any time during the drilling the only defence or shut off between the oil reservoir located deep under the seabed and the drill ship located at great distance above the seabed is the BOP.

During drilling operations the drill pipe which has the drill bit at its end passes through the riser production pipe and the BOP and then down through the well head to the bottom of the oil well. As the well is drilled 'mud' is forced through a drill pipe to the drill bit and returns up the well bore in the ring shaped void or annulus between the outside of the drill pipe and the production pipe. The column of drill mud exerts downward hydrostatic pressure to counter opposing pressure from the formation being drilled. When a 'kick' (influx of formation fluid) occurs, rig operators or automatic systems close the BOP units to stop the flow of fluids out of the well bore.

The BOP is designed to rapidly seal of the space or annulus between the riser pipe and the drill pipe and if necessary to cut through the drill pipe and close off all possible flow. As mentioned, when the blow out begins there is normally a column of heavy mud in the production tubing and the weight of this column helps to slow down the rate of discharge of oil from the reservoir. However as gas or lighter oil replace this mud there is less resistance to vertical discharge and the velocity of the discharging material will continue to accelerate until a steady-state condition of free discharge is achieved. At this point, the material in the entire length of production tubing between the oil reserve and point of discharge is travelling at a velocity that is proportional to the pressure in the oil reservoir and contains a quantity of energy in the form of momentum.

The BOP is a sophisticated electro-mechanical device that includes multiple stages of sealing devices. Its purpose is to stop the uncontrolled discharge of gas and oil and sediment from the oil reservoir. In the early days of oil explorations, before the advent of the BOP, oil geysers or blow-outs were a common occurrence.

Without the sealing mechanism of the BOP, oil would simply flow up through the production tubing and riser piping to the surface vessel at an uncontrolled rate. The rate of discharge will be a function of the pressure in the oil reservoir minus any piping friction losses incurred between the entrance to the production tubing and the point of discharge. If the discharge is flowing through a malfunctioning BOP, it may provide some additional pressure losses particularly if it's closing mechanisms had partially functioned.

Once a situation of free discharge has been achieved the rapid closure of any of the multiple-staged throttling devices in the BOP may result in severe and even destructive stresses on the well head and production casing in the form of water hammer. In the petroleum industry jargon they refer to this as shocking the well.

This invention is designed to provide a solution for shutting down an oil well that has lost the operation of its BOP and is now discharging freely at some point between the riser of the production casing and the surface vessel. If the BOP is not operational it is quite possible that it has incurred some physical damage and will probably, but not necessarily, require its removal prior to beginning the procedure for bringing the well under flow control. Depending upon the cause of the accident and the nature and velocity of the material discharging from the oil well the riser piping may have incurred considerable stresses and erosion that weaken its structural integrity. As such, any solution will require that the minimum amount of stress be applied to the remaining piping and connections.

It is important to understand the basic principles of the problem to understand the development of the philosophy of the solution. Essentially, the problem is the energy in the discharging jet of oil. The energy is generated by the hydrostatic pressure in the oil reservoir and conversely the velocity of the discharging oil jet as the pressure (potential) energy converts into velocity (kinetic) energy. If the pressure in the oil reservoir was less than the pressure of the seawater at well head there would be no flow out of the reservoir. In the Gulf of Mexico, where the water has high levels of dissolved solids, each foot of water equals 0.465 psi.

Accordingly at a depth of 5,000 feet the pressure of the seawater will be approximately 2,325 psi. If the pressure of the oil discharge at 5,000 feet of depth was 2,325 psi, there would be no flow and remotely controlled vehicles would simple bolt or fix an attachment over the open riser piping to stop all possible flow.

However the pressure in an oil reservoir can reach 30,000 psi. As the oil flows up the production tubing between the reservoir and the well head there will be some friction losses and loss of energy from the flow stream but substantial energy will remain and as mentioned is converted into an equivalent amount of kinetic energy or velocity. This increase in kinetic energy and decrease in pressure follows the Bernoulli principle and the Law of conservation of energy.

Based on the Bernoulli principle, the kinetic energy of a flow stream can change by changing the area of the superficies of flow along a streamline. By increasing the surface area of the discharge of the oil we can reduce its velocity and hence the forces it will exert against an object placed in its path. Accordingly, it is possible to decrease the force required to place an object in a flow stream by either decreasing the velocity of the flow or by reducing the surface area of the object that confronts the flow stream.

At the point of discharge the pressure energy of the flow stream is entirely converted into velocity of the flow stream. A simple formula allows to calculate the velocity (V) if the pressure or head (H) is known and is $H=V^2/2\ g$ or V=the square root of (2 gH) where g is the gravitational constant.

In order to place an object in a flow stream one needs to have sufficient force to hold it in place. Flow forces will cause unsupported or insufficiently supported equipment to be thrown aside. The challenge in holding an object in place in a deepwater situation arises from the fact that the working point is at the surface of the ocean that may be miles above. This implies that the shape of any objects inserted through the jet should have an orifice opening of sufficient size such that it can be positioned using the available positioning forces. These forces consist of the force available from an ROV or a surface ship or platform. By lowering a connection pipe from the surface vessel considerable vertical force can be applied and consists of the weight of the pipe and hydraulic loading from the surface vessel.

Overcoming the discharge velocity is the principle engineering challenge and any solution must be able to accommodate a wide range of discharge pressures up to 30,000 psi. Essentially, there is a need for a process whereby an apparatus can be assembled at great depth that has a configuration such that the positioning forces available are sufficient to overcome the forces of the discharge jet against the objects being placed. Without exceeding the point of equilibrium between the forces exerted by the discharge jet versus the available force for positioning the apparatus cannot be assembled.

The magnitude of these two forces will dictate the configuration of the components and evidently a higher flow velocity will dictate the design of components that present less resistance during their placement. The size of the riser piping and connections is fairly standard; the discharge pressure from the oil reservoir is not standard. As such, the solution and its methodology remains the same but the size and configuration will reflect the equilibrium sought between the two opposing forces and will be largely a function of the oil flow velocity. In general, the installation of one discharge orifice or multiple discharge orifices are required at the point of free discharge when a reduced flowing velocity is required to place equipment in the flow stream.

A recent deepwater oil spill for which this invention can be applied is the BP Deepwater Horizon drilling of the Macondo well in the Gulf of Mexico.

A National Commission was established by President Obama to investigate. It clearly establishes the great numbers and effort by BP, the oil industry, government scientists and independent engineering consultants that spent months researching a suitable technique to shut down this oil spill. The effort by BP to partially contain the oil lost was an unsatisfactory solution. The BP attempts to shut down the well by obstructing the flow through the production tubing was totally unsuccessful given the high discharge pressure of the Macondo well. As for the BP position, they indicate on the home page of their BP Global website: 'This was a situation never encountered before and required a number of solutions that were new to BP and the industry'.

The complete National Commission report is available at the following web site: http://www.oilspillcommission.gov/final-report Alternatively, the staff working paper No. 6 prepared by the New York Times is available at: http://graphics8.nytimes.com/packages/pdf/science/Containment-.pdf There was some early consideration given to installing a second BOP at the Macondo well but it was openly admitted that the no one knew how to engineer its installation under the existing severe conditions. The best solution at the time was to increase the containment of the leaking oil by improving the seal between the containment dome and the oil well riser piping and eventually to attempt a bottom kill by injecting mud and concrete through two relief wells.

The intent of this invention is to provide an apparatus and a sequential methodology and method for the design and execution so that free discharging oil risers can be brought under control using a throttling device.

SUMMARY OF THE INVENTION

An object of the present invention is to provide an apparatus and method to address at least one of the above-mentioned needs.

According to the present invention, there is provided a deepwater blow out throttling apparatus for use with at least one riser pipe oil discharge flow, the apparatus comprising:

- a diffusion transition spool section, said transition spool section comprising a feed orifice and an exit orifice assembly, said feed orifice having a surface area lower than said exit orifice assembly, said exit orifice assembly comprising between one and four orifices aligned along a horizontal plane;
- at least one throttling device proximate to said exit orifice assembly of said diffusion transition spool section;
- a connecting device for connecting said exit orifice assembly of said diffusion transition spool section to said throttling device;
- a riser pipe flange connection for connecting the diffusion transition spool section to the riser pipe, said riser pipe flange connection comprising an outlet, said outlet having an area equal to said feed orifice of said transition spool section; and
- an external downward pressure source for applying pressure on the throttling device and the diffusion transition spool section to minimize vertical stresses created by throttling on said riser pipe flange, wherein the oil flow enters through said feed orifice section and exits through said throttling device and wherein said the throttling device is adjustably and gradually closeable to minimize said vertical stresses on said riser pipe flange.

Preferably, the diffusion transition spool section comprises at least one cylindrical section with a length greater than 5 times the diameter of said feed orifice.

Preferably, the external downward pressure source originates from a connecting pipe and a service vessel.

Preferably, the diffusion transition spool section is sized such that the diffusion transition spool section is placed over the oil discharge flow using forces available from at least one of a group of Remote Operated Vehicles or a surface vessel.

Preferably, a diameter of the throttling device is sufficient such that the throttling device is placeable through the discharge flow and held in place by a surface vessel using a connecting pipe supported by a service vessel.

According to the present invention, there is also provided a method for assembling a deepwater blow out throttling apparatus for use with at least one riser pipe oil discharge flow, comprising the steps of:

a) providing a flange connection;

b) placing and connecting a diffusion transition spool section to the flange connection, said transition spool section comprising a feed orifice and an exit orifice assembly, said feed orifice having a surface area lower than said exit orifice assembly, said exit orifice assembly comprising between one and four orifices aligned along a first horizontal plane;

c) placing and connecting at least one throttling device to the diffusion transition spool section through a connecting device;

d) simultaneously slowly closing the at least one throttling device while applying vertical forces thereupon with an external downward pressure source.

Preferably, in step b), the horizontal plane is a first horizontal plane, and step c) comprises the step of placing and connecting a plurality of throttling devices and all of said throttling devices are aligned along a second horizontal plane.

Preferably, the diffusion transition spool section is an integral one-piece welded structure.

Preferably, the apparatus for shutting down the subsea oil well requires the presence of a flanged connection to accept the high stresses generated during throttling.

BRIEF DESCRIPTION OF THE DRAWINGS

These and other objects and advantages of the invention will become apparent upon reading the detailed description and upon referring to the drawings in which:

FIGS. 4, 4*a* and 4*b* are views of the open and closed positions of the clamping connection on a possible three-piece, bolted, and cylindrical, diffusion transition spool, according to a preferred embodiment of the present invention.

FIGS. 5, 5*a* and 5*b* are views of the open and closed positions of the multiple discharges discharge faces on a possible three-piece, bolted, and cylindrical, diffusion transition spool, according to a preferred embodiment of the present invention.

FIG. 6 is a view of an encased in concrete, possible deepwater blow out throttling apparatus that includes a BOP for intended production, according to a preferred embodiment of the present invention.

Figure 1:
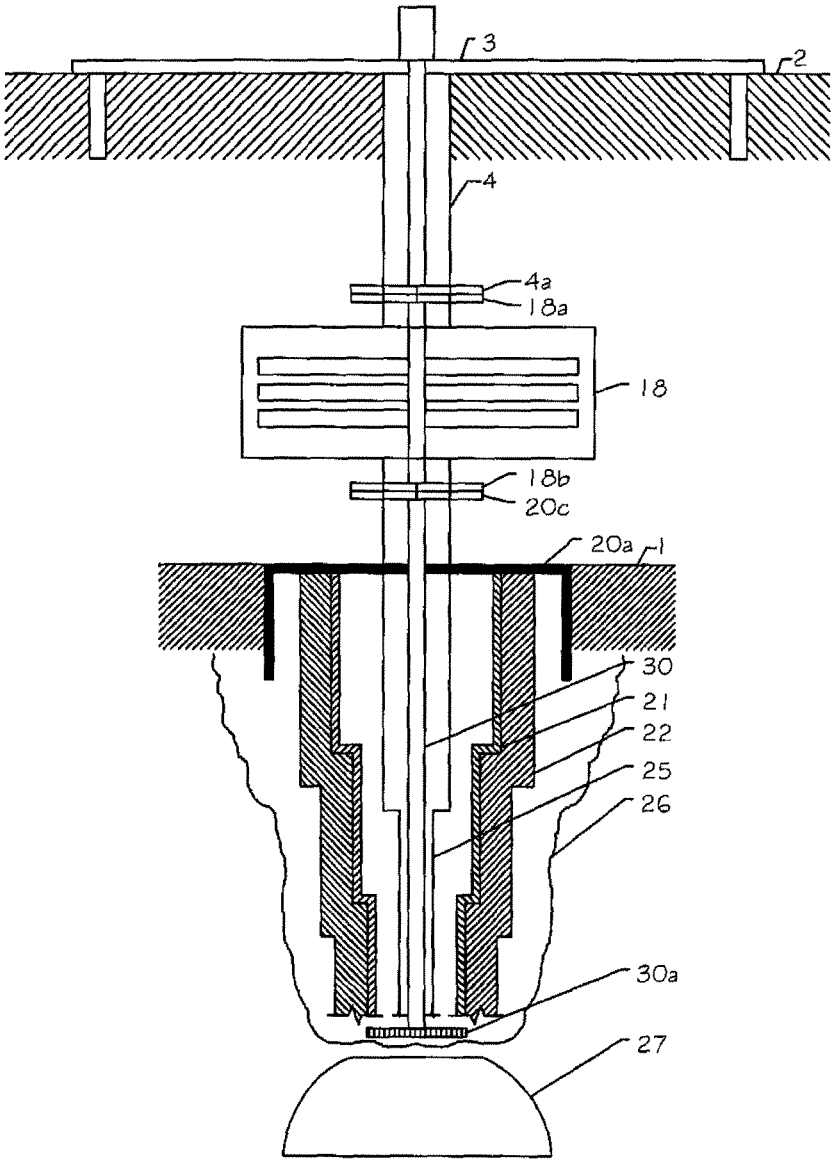
FIGURE 1 (PRIOR ART)
FIG. 1 is a schematic cross-section view of a typical deepwater oil well in drilling mode.

The following is a legend for the above drawings:

1—seabed
2—ocean surface
3—surface vessel
4—production riser
4*a*—production riser mating flange
5—connecting pipe
5*a*—connecting pipe diversion orifice
5*b*—connecting pipe mating flange
10—deepwater blow out throttling apparatus
11—throttling device
11*a*—throttling device mating flange
11*b*—throttling device actuator
11*c*—throttling device blind flange
13—one-piece diffusion transition spool
13*a*—spool feed orifice connection
13*b*—spool discharge orifice connection
14—three-piece diffusion transition spool
14*a*—spool feed orifice clamping device and flanges and actuators
14*b*—spool cylindrical body and flanges
14*c*—spool discharge orifices closing device and flanges and actuators
14*d*—spool discharge blind flange
18—BOP stack
18*a*—BOP feed mating flange
18*b*—BOP discharge mating flange
20—well head
20*a*—well head steel casing
20*b*—well head riser
20*c*—well head riser mating flange
20*d*—well head discharge flow
20*e*—well head load transfer blocks
21—production casing
22—cement
25—production tubing
26—rock formation
27—oil reservoir
30—drill pipe
30*a*—drill pipe bit
31—steel forming
31*a*—forming structural plate and flange
31*b*—forming cylindrical wall and flange
31*c*—concrete load transfer blocks

PREFERRED EMBODIMENTS OF THE PRESENT INVENTION

Different preferred objects of the present invention will now be presented.

A first objective of the invention is to systematically install in place, at great depth, an apparatus which can be firmly attached and sealed to the oil well pipe riser at one of its flanged connections and will provide the capability to gradually throttle the oil flow to zero.

A second objective of the invention is to provide specified adjustable variables in the concept of the apparatus to accommodate all specific site conditions. Assumed discharge pressures are in the range of 1,500 to 30,000 psi and operating depths that are in a typical range of 1,000 to 10,000 feet. Each oil well will have its own characteristics for ocean depth, discharge pressure and velocity in the pipe riser, pipe riser diameter and physical condition. Hence, this invention will offer changes in equipment parameters to adjust to the state of wear and operating conditions of each individual well.

A third objective of this invention is to succeed its installation using the two available means of placing equipment that include the use of one or several ROV and of a drill ship, drill pipe and potential hydraulic loading from the drill ship.

A fourth objective is to provide a system that can be converted into a permanent solution that allows the oil well to be put in production if so desired.

Other and further objects and advantages of the present invention will be obvious upon an understanding of the illustrative embodiments about to be described or will be described or will be indicated in the appended claims, and various advantages not referred to herein will occur to one skilled in the art upon employment of the invention in practice.

An object of the present invention is to provide an apparatus that addresses at least one of the above mentioned objectives.

The aforesaid and other objectives of the present invention are realised by generally providing a pressurized deepwater apparatus that will consist of one or more throttling devices, a diffusion transition spool with one or more orifices composing its discharge and with one orifice comprising its feed and a suitable mechanical connection of the diffusion transition spool to a flange of the riser pipe.

The configuration and dimensions of all components will be determined to limit the forces that must be overcome by the discharging jet of oil. This will require the adjustment of the discharge velocity through the diffusion transition spool and the placing of one or more throttling devices in their open position to reduce the necessary downward and horizontal forces required for placement. The capacity of the ROV and the drill ship and drill pipe to provide vertical downward and horizontal forces to place equipment will dictate the acceptable level of force that can be generated by the discharging jet against the equipment during their installation.

Preferably, the deepwater oil riser throttling apparatus comprises:

- A plurality of structural members that connect together and are centered above the riser pipe at a designated point, in proximity to the seabed, which transfers the vertical forces and vibration produced during throttling to the riser pipe. The designated point may be located before or after the BOP and will depend on the physical condition of the BOP and the riser pipe. If the riser pipe is suspect, hydraulic loading on the drill pipe by the drill ship should be increased as the throttling advances and the hydrostatic pressure against the shut-off valve increases.
- A diffusion transition spool, the transition spool comprising one entry and an exit or exits, the entry having an area equal or smaller than the sum of the area of said exit(s). The diffuser cylinder may be a one-piece welded construction or a multiple piece construction that is bolted together in place. This will depend on the flow forces to be overcome. The hydrostatic capacity of the connections and the cylinder will be superior to the hydrostatic shut off pressure of the oil well.
- One, two or a plurality of throttling devices are mounted fully open on the transition spool in a horizontal orientation. If more than one throttling device is required the last valve or valves to be closed should be centered over the riser to distribute the vertical forces as evenly as possible over the perimeter of the riser pipe.

Temporarily, during assembly of the apparatus and the process of throttling, the use of a drilling pipe extending down from a surface vessel and an addition downward hydraulic force in addition to the pressure applied by the weight of the drilling pipe will be applied against the assembled apparatus. Drill pipe weight may be increased to provide increased pressure.

At the designated point along the riser pipe, a sealed mechanical connection is created between the riser pipe and the entrance orifice of the diffuser cylinder. If at the designated point, an existing mating flange of the riser pipe is available, the two mating flanges can be separated, and assuming the discharge velocity of the oil flow is sufficiently low, the diffusion transition spool will be bolted to the lower mating flange of the riser pipe. In this instance the established 'snub down method' can be used. Snub down method consists of pulling down the transition spool by running two cables through the two flanges to be mated and using wrenches or pulling arms to lead the flanges together.

Another established oil field practice for inserting equipment in flow streams is the 'spin on' technique. Spin on technique use a long stud bolt run between the lower flange of the pipe riser and the mating feed flange of the transition spool. The flanges are positioned 180 degrees out of phase very near one another and one stud is dropped. The transition spool is spun through the flow with the spool splitting the flow stream momentarily as it turns on the stud into the matching position. The spin on technique is usually generally used for low discharge velocity flow streams.

If the forces created by the discharge flow are too high to permit the placement of a diffusion transition spool with a feed orifice equal in diameter to the pipe riser connection or if the well riser connection cannot accept a bolted connection, the diffuser transition spool may be attached to the pipe riser using other types of mechanical connection such as clamping or collars.

If clamping or collars is the chosen type of connection the cylindrical section between the feed orifice and discharge orifice may be in three pieces and bolted in place or installed as one welded piece.

The shape and length of the diffusion transition spool may vary. Its shape will depend largely on the required size and placement of its discharge orifice or orifices.

The discharge orifice or discharge orifices will provide suitable sealed mechanical connections for the throttling device or throttling devices. The number and size of the discharge orifices will be calculated such that the forces of the discharging flow of oil through the orifices are sufficiently low to permit the positioning in place of the throttling devices while in their open position.

These throttling devices could have been installed on a tee shaped spool with one device in the horizontal position and several devices in the vertical position. The throttling devices in the vertical position would play a similar role to that of diverting valves in a typical above ground blow out containment procedure. However, at great depth the vertical forces available to place the devices are too limited. The vertically placed throttling devices could be installed on the tee prior to connecting to the transition spool but the forces required to place the tee may overcome the forces available to hold it in place for connecting. Accordingly all discharge orifices are designed in the horizontal position in order that the drill pipe and drill ship can best supply the vertical and horizontal forces to position them.

The throttling devices once in place will be closed one by one and at such a rate as to provide minimum vertical stresses on the pipe riser. In order to distribute the stresses as evenly as possible the valves can be closed simultaneously. During throttling the weight of a connecting pipe and possibly hydraulic loading from the drill ship will continue to be applied against the throttling devices. This loading is intended to minimise the vertical stresses and vibration transmitted to the connection with the riser pipe during the throttling process.

Preferably, the sequential order for the assembly of the throttling apparatus is as follows:

1) Remove obstructions to better access an existing upward facing pipe riser mating flange. Two locations are available for this, one above and one below the Blow Out Preventer (BOP). Unbolt the existing mating flanges or simply cut the riser above one of the two mentioned flange connections.
2) Design and fabricate a diffusion transition spool piece that can be attached to the pipe riser flange. The spool piece, mounted with the smaller diameter at the bottom attached to the riser pipe flange will provide a larger-diameter flanged or mechanical connection for the throttling valves above.
3) Connect the spool piece to the pipe riser in such a way as to transmit part or all of the vertical and horizontal stresses during throttling to said riser pipe flange and to supply sufficient free flow discharge area through one or multiple flanged discharge orifices that the flow discharge velocity is sufficiently lowered and part of its kinetic energy is diffused.
4) Use the weight of the connecting pipe and drill ship to force each throttling device, in its fully open position, onto the connections of the spool piece orifices and through the diffused flow of oil
5) The throttling devices and transition spool could feature guide pins to make alignment for bolting or mechanical connection easier
6) The connecting pipe would have one or more orifices to ensure that the discharge flow traveling through the open throttling device will not travel up the connecting pipe to the drill ship
7) Gradually close the throttling valves and monitor the structural integrity of the apparatus and riser piping
8) During throttling of flow maintain a downward pressure of the connecting pipe and drill ship to minimise vertical and horizontal stresses against said riser pipe flange.
9) Once throttling is complete and oil flow has stopped, remove the downward force supplied by connecting pipe and drill ship.

In a further embodiment, it may be decided that the original installation and throttling apparatus are to enter permanent production. Accordingly, a new BOP is connected to one of the throttling devices on the top of the transition spool. As a safety measure, the feed connection between the riser pipe and the diffuser transition spool, the diffuser transition spool and the throttling devices are encased in cement with the exception of the shut of valve feeding the new BOP.

Depending on the evaluated capacity of the drill ship and connecting pipe to hold the throttling devices in place there may be multiple discharge orifices from the transition spool that serve to decrease the flow velocity of the discharge and lower the forces required for placement, In the following description, similar features in the drawings have been given similar reference numerals and in order to weight down the figures some elements are not referred to in some figures if they were already identified on a previous figure. A novel deepwater oil well throttling apparatus will be described hereinafter. Although the invention is described in terms of specific illustrative embodiments(s) it is to be understood that the embodiment(s) described herein are by way of example only and that the scope of the invention is not intended to be limited thereby.

FIG. 1 shows a typical arrangement for a deepwater oil well. The drilling vessel (item 3) can lower and place drilling equipment on the seabed (item 1). It can lower drill pipe and a drill bit (items 30 & 30*b*) for well drilling and it can also lower riser pipe (item 4) that is connected by a mating flange (item 4*a*) to the BOP mating flange on the top of the BOP (18) item. A flexible joint may be used. The BOP sits on top of the well head riser (item 20) and the feed BOP mating flange (item 18*a*) is bolted to the well head riser mating flange (item 20*a*). The well head (item 20) sits on the ocean floor and is connected to a well casing (item 23) and to the production casing/tubing (item 25). The well casing is solidified and restrained by cement (item 21) to the rock formation (item 26) over its entire length.

Figure 2:
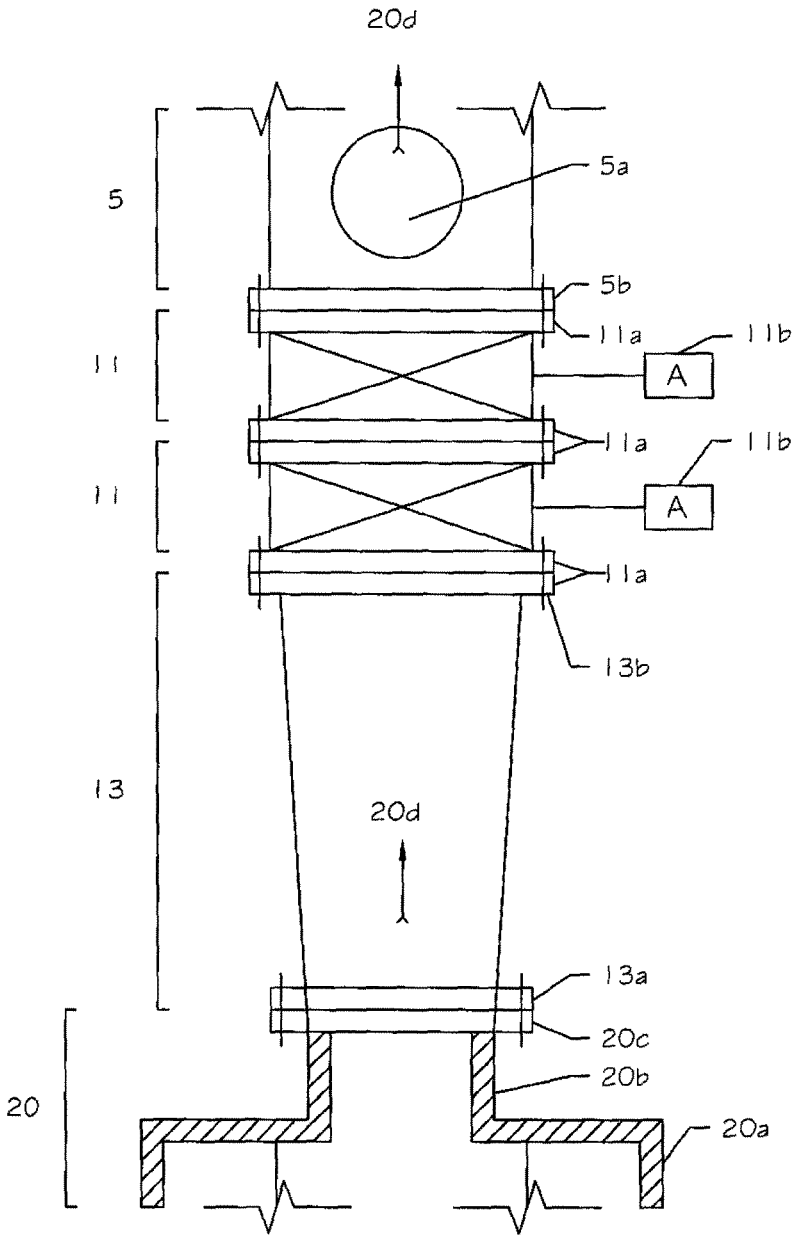
FIG. 2 is a cross sectional view of a possible deepwater blow out throttling apparatus using a one-piece welded, conical, diffuser transition spool and a flanged attachment, according to a preferred embodiment of the present invention.

FIG. 2; shows the basic configuration of a possible apparatus for throttling a deepwater oil well in a condition of blow out. It has been determined that the restraining forces available through the use of the ROVs, the connecting pipe and service vessel have generated a preferred embodiment in which the throttling apparatus is installed by forcing the transition spool (item 13) through the flowing discharge and bolting the spool inlet mating flange (item 13*a*) to the well head riser flange (item 20*b*).

Two throttling devices are then pushed through the flowing discharge and the discharge orifice connection (item 13*b*) is attached to the inlet mating flange connection of the throttling device (item 11*a*). The two throttling devices have been placed by the connecting piping (item 5). As it is required that the throttling devices be in the open position when installed it is necessary to have sufficient diverting orifices (item 5*a*) cut in the connecting pipe to prevent the flowing discharge from continuing up to the service vessel as an uncontrolled stream. As all the throttling from free discharge to shut off will occur over one throttling device and given the strong possibility of erosion from sand and particles a second throttling valve is installed as a safety measure.

Figure 3:
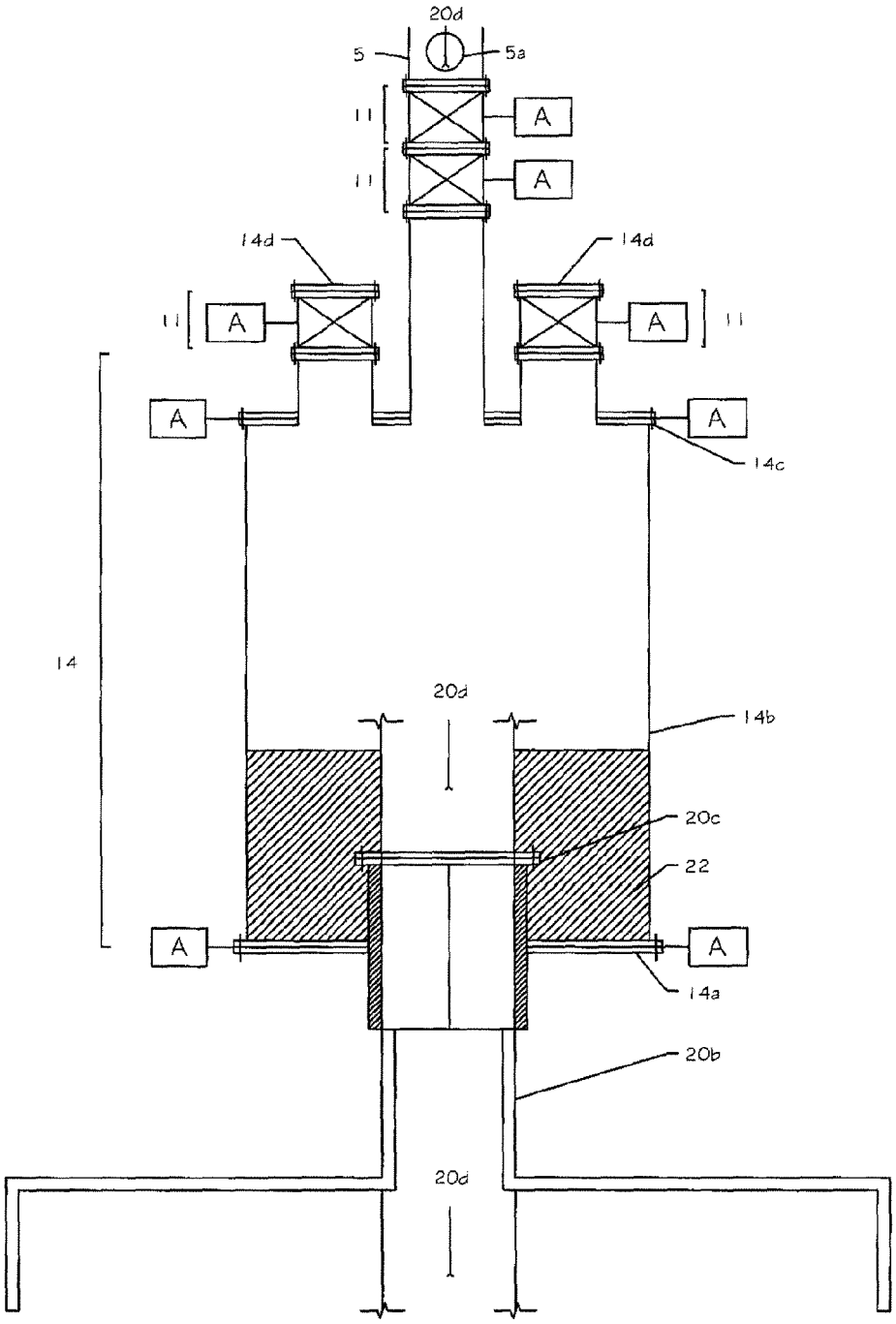
FIG. 3 is a schematic cross-section view of a possible deepwater blow out throttling apparatus using a possible three-piece, bolted and cylindrical diffusion transition spool and a clamping attachment, according to a preferred embodiment of the present invention.

FIG. 3 shows the basic configuration of a possible apparatus for throttling a deepwater oil well in a condition of blow out. It has been determined that the restraining forces available through the use of the ROVs, the connecting pipe and service vessel have generated a preferred embodiment in which the throttling apparatus is installed by avoiding to force the transition spool through the flowing discharge and bolting the spool inlet mating flange (item 13*a*) to the well head riser flange (item 20*b*) as per FIG. 2. This would be the result of a situation whereby there is an increase in the distance between the working point and the surface vessel or an increase in the oil flow pressure at the point of discharge due particularly to a higher oil reservoir pressure.

The diffusion transfer spool is a three piece bolted construction; installation begins by placing the feed orifice closing device (item 14*a*) at a height just below one of the two possible flange connections. Once in place the actuators close the gates such that the two semicircular shoes, having the same diameter as the outside diameter of the riser, are now firmly pressing against the riser.

The spool cylindrical body (item 14*b*) which has a diameter larger than the riser discharge is easily dropped into place and bolted to the matching flange of the feed orifice closing device (item 14*a*). At this point concrete is poured into the spool cylindrical body until it approaches the height of the riser discharge. This concrete will serve to seal the bottom orifice plate and the intreface between the shoes pressing against the outside of the riser pipe. This concrete will also provide vertical stability as stresses are now transferred over a longer length of pipe rather than being concentrated solely at the neck of the riser flange.

The spool discharge orifice closing device (item 14*c*) is brought into position by the connecting pipe of the service vessel and bolted in place. The closing mechanism is actuated and the two gates with discharge orifices close. The throttling devices may be installed on the discharge orifice closing device before it is installed. This will however increase the forces exerted by the discharge flow. One by one, each throttling device (item 11) is positioned by the restraining force of the connecting pipe and service vessel, and bolted in place in their fully open position. Once all the throttling devices are in place, the throttling procedure may begin. This procedure will be designed to minimise the stresses transferred to the transition spool. In general, as the throttling continues and the hydrostatic pressure in the system increases the connection pipe and service vessel provide addition downward force on the throttling valves and/or throttling assembly to minimise the vibration and vertical stresses on the existing oil well piping.

Assuming a situation where three throttling valves are employed and are closed in sequence, it is evident that only the last orifice closed will incur a considerably higher differential shut off pressure. It would be advisable to install blank flanges (item 14*d*) on the discharge of the first two valves closed to prevent leaks. The last valve closed would include two throttling devices in series for added protection against wear from erosion during the last high pressure throttling process.

FIG. 4 illustrates the movement of the feed orifice closing device (item 14*a*) of the transition spool designed for higher discharge pressures.

FIG. 5 illustrates the movement of the discharge orifice closing device (item 14*c*) of the transition spool designed for higher discharge pressures.

FIG. 6 illustrates a suggested procedure such that if once the blow out is shut in, it is decided to put the oil well into production. For reasons of security, the Applicant suggests that the entire deepwater blow out throttling apparatus be encased in concrete. This is achieved by placing multiple support blocks (item 31*c*) around the top of the well head and a two-piece bolted circular structural plate (item 31*a*) is placed around the well head riser just below the feed orifice clamping device. A cylinder (item 31*b*) is then bolted to the circular structural plate, reinforced and filled with concrete (item 22) to the level of the throttling device that will now feed a new BOP (item 18).

This is strictly a safety precaution as many new joints have been added into the system. The weight of the cylinder will also relieve vertical stresses on the well head. If a well has been damaged or accidentally shocked (hammered) this additional weight would greatly reduce the vertical stress on the well head and if sufficient weight is added could place the entire oil well structure in compression rather than in tension. This could be very important if an oil well was leaking around the well head.

In a preferred embodiment of this invention, the spool discharge orifice closing device with actuators is replaced by a one-piece circular head piece that contains the desired number and size of discharge orifices and offers resistance in contact with the discharge flow of a magnitude that it can be positioned by the restraining forces available from the connecting pipe and service vessel. Similarly the feed orifice clamping device (item 14*c*) of the three-piece bolted transition spool may be replaced by the flanged connection of the one-piece transition spool (item 13*a*) and the three-piece transition spool may become a two-piece transition spool as the circular spool body (item 14*b*) may be inserted at the same time as the flange connection is attempted.

In a preferred embodiment of this invention, the connecting pipe used to place the throttling devices will have the same diameter as the devices. This will maximise the weight of the pipe, adding stability and will maximize the hydraulic forces that can be applied by the surface vessel during throttling.

The embodiments of the present invention, with respect to adjusting the forces created by the flowing oil by adjusting the surface area of the free discharge are obtained using the principles of Bernoulli and the Law of Conservation of energy. The reduction in applied forces by reducing the discharge velocity is described in the non limitative following example that is based on results obtained by simulating conditions. As mentioned, one knows that by the principle of Bernoulli that oil flowing around similar structures with different velocities will demonstrate different restraining forces and that the differences in force would be proportional to the oil flow velocity.

As the person skilled in the art would understand, a plurality of types of mechanical connections, of discharge orifices on the transition spool and of throttling devices may be used with the apparatus of present invention, for example, for example a bolted or clamping mechanism to hold the apparatus in place. Also for each oil reservoir and its discharge pressure, different combinations may be used, for example a different number and/or configuration of discharge orifices, the distance between the feed orifice and discharge orifice of the transition spool, the change in diameter of the transition spool, and the diameter and number of throttling devices etc.

As the person skilled in the art would understand, the parameters of the deepwater blow out throttling apparatus and its assembly may differ from the examples shown in this document. Similarly, the parameters of the equipment used to assemble the apparatus will vary depending upon the site conditions and the equipment that the drilling team are accustomed to.

As the person skilled in the art would understand, in the case of a free discharge stream that offers a low flow velocity and occur a reasonable depth, the one-piece and welded transition spool will offer the best solution. However, for a worst case scenario with a free discharge based on a pressure of 30,000 psi in the oil reservoir and tethered at a depth of 8,000 feet, the three-piece and bolted transition spool with its ability to provide substantial discharge surface area will offer the best alternative. The throttling of a high flow velocity require larger ratios between the applied forces from the flow on the equipment and the force available for positioning the equipment which are claimed herein.

As a person skilled in the art would understand, the configuration of the diffuser transition spool may be conical, cylindrical or another shape that can resist the hydrostatic pressures. The size and shape will always be a function of the type of connection used to connect the feed orifice of the transition spool and the surface area required for the discharge orifices of the spool.

In a further embodiment the total surface area of the discharge orifices sufficiently decrease the flow velocity or that the depth to the designated point in the pipe riser is so short, that the entire apparatus can be positioned while fully assembled.

The device according to the present invention can be used for capping and a shutdown for possible repairs and then a restart in production.

Moreover, the conditions of the BOP and the riser piping between the BOP, the well head and the surface vessel will impact the location of the point of intervention with the throttling device.

It is also to be understood that a throttling device is, among other things, a mechanical means for gradually obstructing a flow from a state of free discharge to zero or negligible flow.

Although preferred embodiments of the present invention have been described herein and illustrated in the accompanying drawings, it is understood that the invention is not limited to these precise embodiments and that various changes and modifications may be effected therein without departing from the scope of the spirit of the present invention.

What is claimed:

1. A deepwater blow out throttling apparatus for use with at least one riser pipe oil discharge flow, said apparatus comprising:

a diffusion transition spool section, said transition spool section comprising a feed orifice and an exit orifice assembly, said feed orifice having a surface area less than said exit orifice assembly, said exit orifice assembly comprising between one and four orifices aligned along a horizontal plane;

at least one throttling device proximate to said exit orifice assembly of said diffusion transition spool section;

a connecting device for connecting said exit orifice assembly of said diffusion transition spool section to said throttling device;

a riser pipe flange connection for connecting the diffusion transition spool section to the riser pipe, said riser pipe flange connection comprising an outlet, said outlet having an area equal to said feed orifice of said transition spool section; and an external downward pressure source for applying pressure on the throttling device and the diffusion transition spool section to minimize vertical stresses created by throttling on said riser pipe flange, wherein the oil flow enters through said feed orifice section and exits through said throttling device and wherein said throttling device is adjustably and gradually closeable to minimize said vertical stresses on said riser pipe flange.

2. The apparatus according to claim 1, wherein the diffusion transition spool section comprises at least one cylindrical section with a length greater than 5 times the diameter of said feed orifice.

3. The apparatus according to claim 1, wherein the external downward pressure source originates from a connecting pipe and a service vessel.

4. The apparatus according to claim 1, wherein said diffusion transition spool section is sized such that the diffusion transition spool section is placed over the oil discharge flow using forces available from at least one of a group of Remote Operated Vehicles or a surface vessel.

5. The apparatus according to claim 1, wherein a diameter of the throttling device is sufficient such that the throttling device is placeable through the discharge flow and held in place by a surface vessel using a connecting pipe supported by a service vessel.

6. A method for assembling a deepwater blow out throttling apparatus for use with at least one riser pipe oil discharge flow, comprising the steps of:

a) providing a riser pipe flange connection for connecting a diffusion transition spool section to the riser pipe, said riser pipe flange connection comprising an outlet, said outlet having an area equal to a feed orifice of said transition spool section;

b) placing and connecting the diffusion transition spool section to the flange connection, said transition spool section comprising an exit orifice assembly, said feed orifice having a surface area less than said exit orifice assembly, said exit orifice assembly comprising between one and four orifices aligned along a horizontal plane;

c) placing and connecting at least one throttling device to the diffusion transition spool section through a connecting device;

d) simultaneously slowly closing the at least one throttling device while applying vertical forces thereupon with an external downward pressure source.

7. The method according to claim 6, wherein in step b), said horizontal plane is a first horizontal plane, and step c) comprises the step of placing and connecting a plurality of throttling devices and all of said throttling devices are aligned along a second horizontal plane.

8. The method according to claim 6, wherein the diffusion transition spool section is an integral one-piece welded structure.

* * * * *